US005477897A

United States Patent [19]

Scofield

[11] Patent Number: 5,477,897

[45] Date of Patent: Dec. 26, 1995

[54] OIL RECOVERY SYSTEM

[76] Inventor: Brian S. Scofield, P.O. Box 56, Rte. 28A, West Shokan, N.Y. 12494

[21] Appl. No.: 243,940

[22] Filed: May 17, 1994

[51] Int. Cl.[6] ..... B65B 1/04; B65B 3/04

[52] U.S. Cl. ..... 141/105; 141/106; 141/364; 141/98; 184/1.5; 184/106

[58] Field of Search ..... 141/98, 105, 106, 141/107, 363, 364, 365, 375, 339; 184/1.5, 106; 220/573, 572, 375, 663; 217/110

[56] References Cited

U.S. PATENT DOCUMENTS

| | | | |
|---|---|---|---|
| 118,051 | 8/1871 | Price | 141/106 X |
| D. 252,372 | 7/1979 | Macaulay | D7/70 |
| D. 300,290 | 3/1989 | Moberg | D6/469 |
| D. 310,170 | 8/1990 | Bartz | D9/374 |
| D. 331,791 | 12/1992 | Ferguson | 23/202 |
| 418,738 | 1/1890 | Mowll | 141/339 |
| 478,303 | 7/1892 | Allgood | 141/106 |
| 483,664 | 10/1892 | Aborn | 141/106 |
| 578,671 | 3/1897 | Wisdom | 141/106 |
| 637,963 | 11/1899 | Howard | 141/106 |
| 2,071,944 | 2/1937 | Hoffman | 141/106 X |
| 2,609,970 | 9/1952 | Blumson | 220/375 |
| 3,393,824 | 7/1968 | Appleton | 220/375 X |
| 3,410,438 | 11/1968 | Bartz | 141/98 X |
| 3,643,704 | 2/1972 | Carr | 141/106 |
| 4,010,863 | 3/1977 | Ebel | 220/573 |
| 4,114,660 | 9/1978 | Arruda | 141/98 |
| 4,632,268 | 12/1986 | Melzi et al. | 220/573 |
| 4,665,958 | 5/1987 | Holloway et al. | 141/106 |
| 4,673,081 | 6/1987 | Habig et al. | 206/223 |
| 4,702,290 | 10/1987 | Perez | 141/332 |
| 4,823,947 | 4/1989 | Maynard, Jr. | 141/98 X |
| 4,832,095 | 5/1989 | Bonnell | 141/106 |
| 5,190,085 | 3/1993 | Dietzer | 141/98 |
| 5,222,534 | 6/1993 | Wilkinson, Jr. | 141/88 |
| 5,269,354 | 12/1993 | Koberg | 141/106 |

FOREIGN PATENT DOCUMENTS

| | | | |
|---|---|---|---|
| 151456 | 5/1957 | Australia | 220/663 |
| 459870 | 6/1957 | Italy | 220/667 |

*Primary Examiner*—Henry J. Recla
*Assistant Examiner*—Steven O. Douglas
*Attorney, Agent, or Firm*—Henry S. Muller; Rhodes & Ascolillo

[57] ABSTRACT

A recovery system for new oil including a first closed container with two sealable openings, one used for filling and one used for draining the container. A second container having six open ports on one side for receiving empty one quart oil containers and a single port at the lowest point on the other side adapted to fit into the first container fill opening, and means to stabilize the container over the fill opening. A sight window with indicia is located in the first container to provide an indication of the quantity of clean oil stored.

10 Claims, 2 Drawing Sheets

OIL RECOVERY SYSTEM

BACKGROUND OF THE INVENTION

1. Field of the Invention

The invention relates to the recovery of liquids from containers and more particularly to the collection of new oil from small containers into a large single container.

2. Description of the Prior Art

It seems that in recent times more people have begun to change their own motor oil, be it car, truck or lawn mower. In each instance, there is old waste oil to dispose of and since it is no longer acceptable to simply deposit it in a hole in the backyard there has come to the market a plethora of various containers to collect waste motor oil.

The average individual who changes his own motor oil will purchase four or five single quart containers of his favorite brand and weight of oil. After draining the old contaminated oil into one of the many available waste oil containers, he will add the new fresh oil. Depending upon the ambient temperature and the viscosity of the oil, the fresh oil will flow either fast or slow. The warmer it is and the thinner the viscosity of the oil the faster it will flow and the colder and thicker the slower it will flow. It is an observation that most owners like to perform their vehicle maintenance in less than one hour, this includes cleaning the interior, washing the exterior, changing the oil and lubricating as necessary. As a result of this apparent self imposed time constraint, the oil is not allowed to completely drain from the quart containers. As a result many individual quart containers of motor oil reach the land fills still containing some quantity of oil. While the ounce, more or less, left in one container will not effect our environment, the total left in landfills each Saturday afternoon cannot help it. This invention facilitates the collection of new oil from single quart containers.

The following U.S. Patents represent the state of the art and constitute the most relevant although non anticipatory art available. U.S. Pat. No. Des. 252,373 issued Jul. 17, 1979 to Macaulay for a bottle drainer; U.S. Pat. No. 4,673,081 issued Jun. 16, 1987 to Habig et al. for a waste oil collector and storage container; U.S. Pat. No. Des. 300,290 issued Mar. 21, 1989 to Moberg for a bottle draining stand; U.S. Pat. No. Des. 310,170 issued Aug. 28, 1990 to Bartz for a waste oil collector and storage container; U.S. Pat. No. Des. 331,791 issued Dec, 15, 1992 to Ferguson fort a combined oil drain pan and container, and U.S. Pat No. 5,222,534 issued Jun. 29, 1993 to Wilkinson, Jr. for a container restraint or holder.

SUMMARY OF THE INVENTION

The invention is a collection system for gathering new oil or other fluids from individual small containers usually, but not necessarily, of the single quart variety. A ported container having a sloping shape on at least one side akin to a funnel contains an outlet port for the draining oil to pass into a storage container. The opposing side of the container contains six ports adapted to receive single quart oil containers or the like, inverted, thereby allowing the dregs of oil to drain out onto the slopes of the opposing side of the container. The outlet of the container is particularly adapted to fit into the opening of a storage container, and legs on the container complement the fit to a storage container. The storage container is provided with a drain in order that the oil might be saved and used in an engine as originally intended. The storage container also includes an window with indicia to quickly show the amount of oil recovered.

It is therefore an object of the invention to provide a new and improved new oil recovery system.

It is another object of the invention to provide a new and improved new oil recovery system that is environmentally safe.

It is a further object of the invention to provide a new and improved new oil recovery system that is light weight, compact and easy to handle.

It is still another object of the invention to provide a new and improved new oil recovery system that is low in cost.

It is still a further object of the invention to provide a new and improved new oil recovery system which is of a durable and reliable construction.

It is another object of the invention to provide a new and improved new oil recovery system which may be easily and efficiently manufactured and marketed.

These and other advantages, features and objects of the invention will become more apparent from the following description taken in connection with the illustrative embodiment in the accompanying drawings.

DETAILED DESCRIPTION OF THE DRAWING

Figure 1:
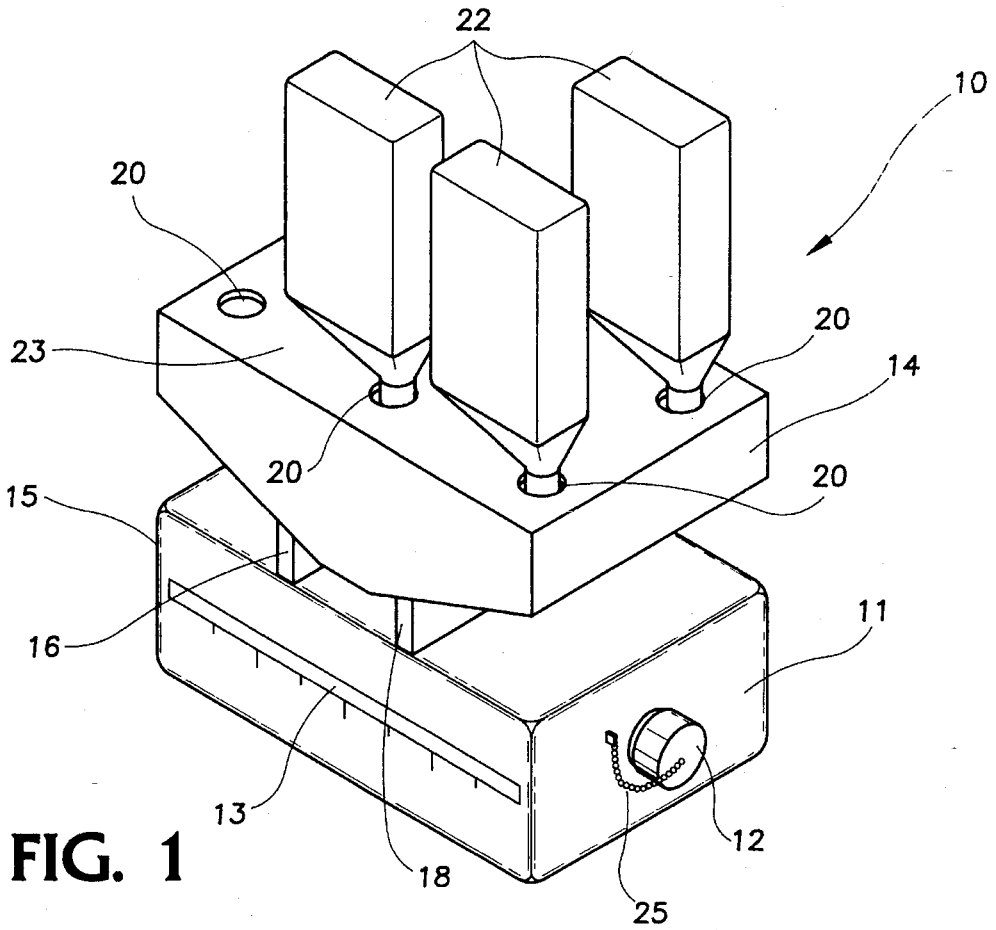
FIG. 1 is a perspective view of the invention.

Referring now to FIG. 1, the inventive system is shown generally at 10. A storage container 11 is shown with a cap 12 closing one opening. A window 13 is located in the side of the container with indicia to show the quantity of oil recovered when the container is positioned with the narrow end 15 down and the capped end up. Container 14 is shown resting in its operative position, stabilized by legs 16 and 18 with ports 20 receiving containers 22. Besides containing ports 20 panel 23 acts as a dust and dirt shield protecting the oily surfaces from ambient dirt and dust that would otherwise contaminate the new oil.

Figure 2:
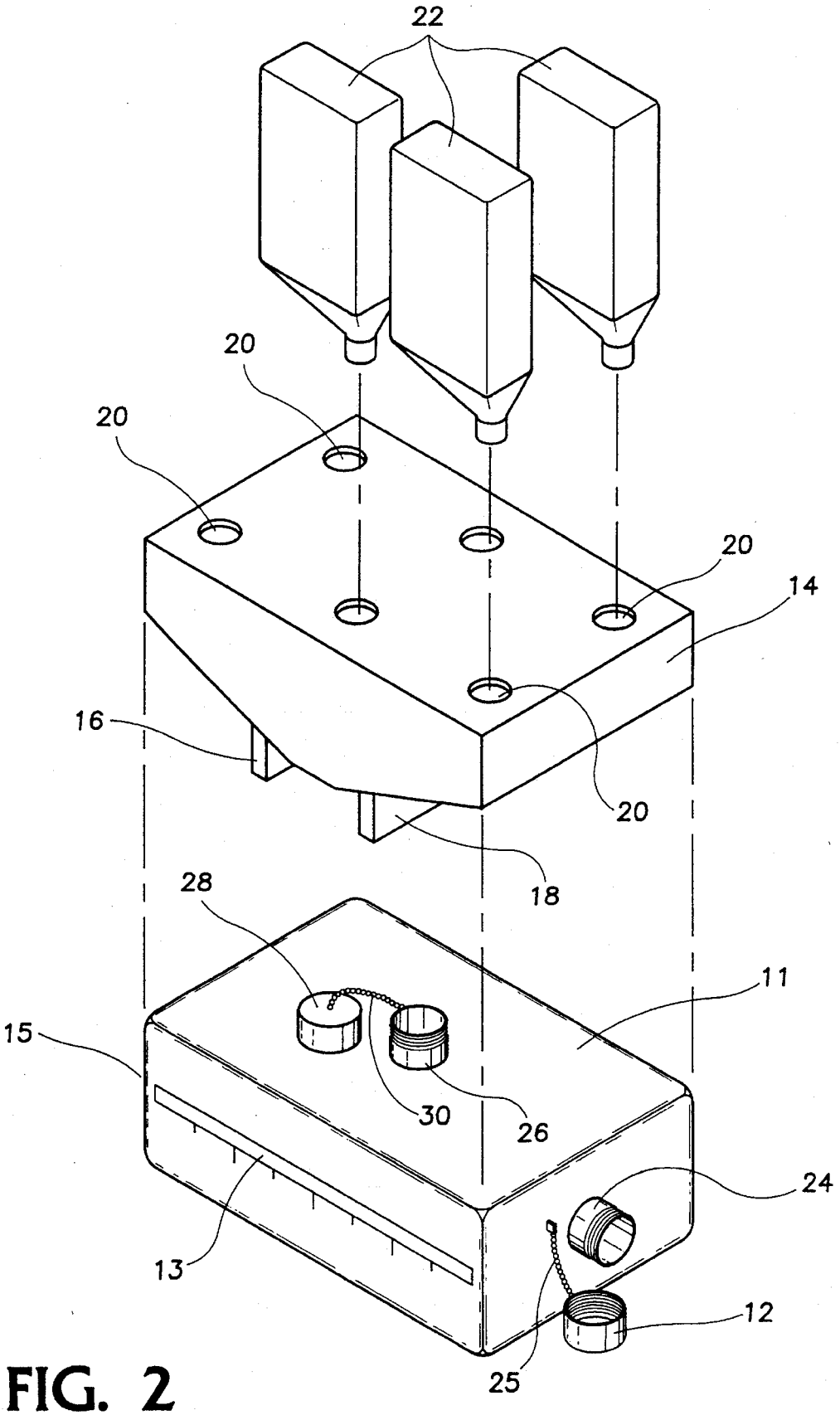
FIG. 2 is an exploded perspective view of the invention.

FIG. 2 shows the invention in exploded form and further showing threaded container opening extensions 24 and 26. Extension 24 is designed to empty the container when it has recovered the desired quantity of new oil. Cover 12 is connected to the extension by a plastic chain 25. Filler extension 26 is adapted to receive the outlet port of container 14 and is sealed by cap 28 secured to the container by plastic chain 30.

Figure 3:
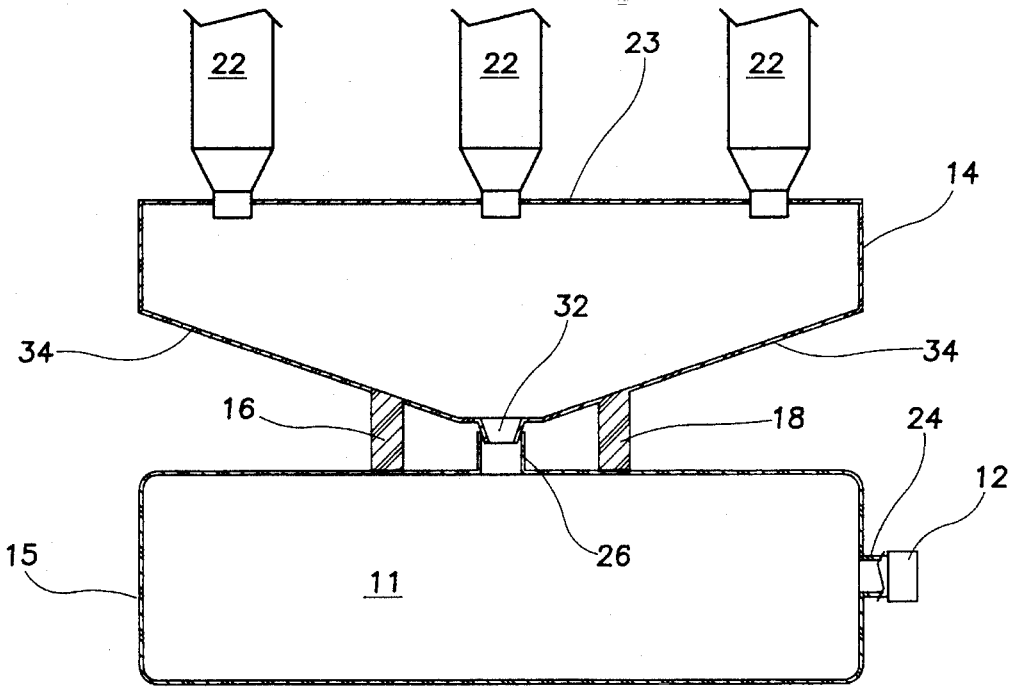
FIG. 3 is a cross sectional view of the invention.

The view of the invention from FIG. 3 shows container 14 overlying container 12 with port 32 engaged in the filler extension 26. Port 32 is located at the nadir of the sloping side 34 of container 14. Fluid dripping from the containers 22 positioned in ports 20 will find its way to the outlet port 32 and into container 11.

The process is intended to be slow and the containers in position for some period of time as the lubricants will flow almost entirely into the larger container, leaving them in condition for recycling. When sufficient oil has been recovered the storage container can be emptied by putting the oil into an engine and used for the purpose intended or in the alternative discarding the oil in an environmentally safe manner.

It should be understood, of course, that the foregoing disclosure relates to only a preferred embodiment of the invention and that numerous modification or alterations may be made therein without departing from the spirit and scope of the invention as set forth in the appended claims.

What is claimed is:

1. A new oil recovery system comprising:

a) a first closed container having a first opening and a second opening;

extension means for positioning an aperture of the first and second openings away from the first closed container, said extension means further comprising a male threaded portion;

b) means for selectively sealing each said opening;

c) a second container having inlet ports in one surface and an outlet port in an opposed surface, said outlet port adapted to engage said first opening on said first closed container; and d) means for stabilizing the second container in juxtaposition to the first closed container.

2. The new oil recovery system according to claim 1 wherein: the means for sealing the opening is a cap.

3. The new oil recovery system according to claim 2 wherein: the cap includes a female threaded portion adapted to engage the extension male threaded portion.

4. The new oil recovery system according to claim 3 wherein: the outlet port of the second container is located at the nadir of its surrounding surface.

5. The new oil recovery system according to claim 4 wherein: the means for stabilizing the second container include a plurality of legs extending from the second container.

6. The new oil recovery system according to claim 5 further including: means for securing each cap to the first closed container.

7. The new oil recovery system according to claim 6 wherein: the means for securing the cap is a plastic chain.

8. The new oil recovery system according to claim 7 wherein: the second container includes six inlet ports.

9. The new oil recovery system according to claim 8 wherein: the first closed container includes means for measuring the quantity of liquid contained therein.

10. The new oil recovery system according to claim 9 wherein: the liquid measuring system includes, a window in the second container and indicia associated therewith indicating quantity levels.

* * * * *